United States Patent [19]

Kageyama et al.

[11] 4,339,329

[45] Jul. 13, 1982

[54] LIQUEFACTION OF COAL

[75] Inventors: Yoichi Kageyama, Isehara; Masato Aiura; Kikuo Moriya, both of Tokyo, all of Japan

[73] Assignee: Mitsubishi Chemical Industries, Ltd., Tokyo, Japan

[21] Appl. No.: 128,151

[22] Filed: Mar. 7, 1980

[30] Foreign Application Priority Data

Mar. 16, 1979 [JP] Japan ..... 54-30737

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 4,176,041 | 11/1979 | Mori et al. | 208/10 |
| 4,214,977 | 7/1980 | Ranganathan et al. | 208/10 |

FOREIGN PATENT DOCUMENTS

| | | | |
|---|---|---|---|
| 20992 | 1/1930 | Australia | 208/10 |
| 24642 | 9/1935 | Australia | 208/10 |
| 106269 | 1/1939 | Australia | 208/10 |
| 108888 | 4/1940 | Australia | 208/10 |

OTHER PUBLICATIONS

"Optical Mineralogy", Kerr. Columbia University, 3rd ed. McGraw-Hill, 1959, pp. 195, 207.

Chemical Engineers Handbook, Perry Ed., 4th ed. McGraw-Hill Book Co., N.Y., 1963. (21-50)-(21-51).

*Primary Examiner*—Delbert E. Gantz

*Assistant Examiner*—William G. Wright

*Attorney, Agent, or Firm*—Oblon, Fisher, Spivak, McClelland & Maier

[57] ABSTRACT

A heavy liquefied coal which is a source for carbon products is produced by heating coal with a hydrocarbon solvent under a hydrogen pressure atmosphere in the presence of a catalyst of a pulverized iron ore.

4 Claims, No Drawings

LIQUEFACTION OF COAL

BACKGROUND OF THE INVENTION

1. FIELD OF THE INVENTION

The present invention relates to a liquefaction of carbon source such as bituminous coal, brown coal and lignite. More particularly, it relates to a liquefaction of coal for producing a liquefied product containing heavy oil by heating a carbon source with a hydrocarbon solvent under hydrogen pressure.

DESCRIPTION OF THE PRIOR ARTS

In general, a solid coal is converted to be soluble in a solvent under a hydrogenolysis of condensed ring aromatic compounds as components of coal by heating coal with a hydrocarbon solvent under hydrogen pressure. Then, insoluble coal and ash in coal which remain as insoluble matters in the solvent without the hydrogenolysis are separated by a filtration etc. and the solvent is distilled to obtain a liquefied product as a solvent refined coal. The solvent refined coal has been mainly developed as a nonpollution fuel of coal. Thus, it can be converted into light oil such as naphtha and gasoline by certain treatment such as hydrogenolysis. The solvent refined coal itself or a modified one can be also used as a source for producing valuable carbon products as applications beside fuels.

Recently, a caking coal is indispensable as a carbon source in a production of a blast furnace coke from the viewpoint of coke strength. Thus, it has been considered that the supply of the caking coal will be difficult from the viewpoints of natural source and its cost.

On the other hand, it has been proposed to produce a coke having high strength from non-caking coal by using a newly developed binder.

It is important to obtain valuable carbon sources such as binder for coke by modifying bituminous coal, brown coal and lignite especially brown coal and lignite which are easily available in low cost as more than 40% of world coal deposits, but are only small demands as fuel because of low rank of coalification.

When a slight hydrogenolysis of coal is carried out in the solvent refining carbonization, cleavages of bonds for bonding side chains and functional groups and aromatic condensed rings of the condensed ring aromatic compounds in the coal are caused to dissolve the aromatic condensed ring portions into the solvent. The solvent refined coal obtained by dissolving the aromatic condensed ring portions contains many components insoluble to hexane or benzene, but soluble to quinoline. That is, the solvent refined coal contains only small content of light oils, but much carbon source and accordingly, it is expected to be used as carbon products.

In usual, such solvent refining of coal is carried out at a reaction temperature of 375° to 450° C. under a hydrogen pressure of 50 to 200 kg/cm$^2$ G. The reaction can be performed in the absence of a catalyst, though a rate of insoluble carbons is higher to be lower yield of the solvent refined coal. Moreover, side reactions of carbonization and thermal decomposition may be caused whereby a precise control of the operating conditions is required in an industrial process to be difficult industrial problems.

When a catalyst is used in the solvent refining of coal, the reaction is performed in the condition suspending the catalyst in a slurry of coal and a solvent. In order to obtain an ashless solvent refined coal, it is necessary to separate ashes and insoluble coal by a filtration etc. After the reaction. When a content of the catalyst is much, a trouble of a separation is caused.

When the solvent refined coal is used as a caking coal for a production of coke, it is not always necessary to separate ashes, and an ash-containing solvent refined coal can be used. Thus, even in such case, much insoluble coal and ashes in the solvent refined coal causes lower yield of the solvent soluble coal and inferior quality as a substituent of caking coal and accordingly, it requires to add a highly active catalyst which is effective at a small content.

It is possible to obtain light oil by deashing and hydrogenolysis of the ash-containing solvent refined coal. Even in such case, the insoluble coal causes lower yield of light oil and accordingly, a highly active catalyst is preferable.

In the solvent refining carbonization, the catalyst is not recovered and accordingly, it is not preferable to use a large amount of a catalyst from the viewpoint of cost.

Various kinds of catalysts for liquefaction of coal have been developed. Thus, these developments are mainly for conversion of coal into light oil especially gasoline. There is not any report for a catalyst which is effective for producing heavy liquefied product which mainly contains components soluble to quinoline but insoluble hexane and benzene. For example, it is well-known that Co—Mo—$Al_2O_3$ type catalyst is effective for the liquefaction of coal, however, the Co—Mo—$Al_2O_3$ type catalyst is expensive and requires a large hydrogen consumption as a catalyst for the solvent refining whereby the resulting solvent refined coal contains much light oil i.e. components soluble to hexane or benzene. The product is not suitable as a source of carbon products.

Iron type catalysts such as iron oxides and iron sulfides have been used as a catalyst for liquefaction of coal, however the catalytic activity is low to be suitable for producing heavy liquefied products. Thus, much catalyst is required for higher solubilization of coal to solvents.

The inventors have studied catalysts suitable for producing the solvent refined coal which can be used as a source for carbon products from a coal in low rank of coalification such as brown coal and have found to obtain a catalyst having high catalytic activity by mechanically grinding an iron ore containing iron oxide as a main component which is easily available in low cost.

SUMMARY OF THE INVENTION

It is an object of the present invention to provide a liquefaction of coal for producing a liquefied product containing mainly heavy oil which is useful as a source for carbon products by using an economical catalyst which is easily available.

The foregoing and other objects have been attained by using a catalyst obtained by grinding an iron ore in a liquefaction of coal by heating coal in a hydrocarbon solvent under hydrogen pressure.

DETAILED DESCRIPTION OF THE PREFERRED EMBODIMENTS

The inventors have studied relations of particle sizes of iron ore to catalytic activities in a solvent refining carbonization by using pulverized iron ores having various particle diameters obtained by mechanically grinding various iron ores and seiving it. As a result, surprizing relations of particle sizes of iron ore to catalytic activities as smaller particle size of iron ore having remarkably higher catalytic activity have been found.

In general, a specific surface area of a catalyst is increased depending upon smaller particle diameter to increase the catalytic activity per unit weight of the catalyst. In the mechanical grinding treatment of iron ore of the present invention, a higher catalytic activity is given by pulverized iron ore having smaller particle size as a comparison of catalytic activity per unit specific surface area. As a result, the inventors have found that new active surfaces having remarkably high catalytic activity are surprisingly formed on the newly formed surfaces by mechanically grinding iron ore.

In the pulverized iron ore catalyst, particle diameter for imparting high catalytic activity is less than 40μ preferably less than 15μ for at least 50 wt.% of the catalyst.

The pulverized iron ore having such particle size is usually added at a ratio of 0.1 to 10 wt.% preferably 0.5 to 2.0 wt.% based on the anhydrous ashless coal whereby the liquefaction of coal in the solvent can be well attained.

When a pulverized iron ore having smaller particle size, the catalytic activity is further improved to be effective by using a smaller amount of the catalyst. The particle diameter is decided together with a cost for grinding or a problem for handling.

When the catalyst of the present invention is used, a solubility of coal to the solvent is high and a hydrogenolysis of coal is finished at relatively low degree and a consumption of hydrogen is not much. The resulting solvent refined coal contains much heavy oil which is useful as a source of carbon products.

The pulverized iron ore having desired particle size can be obtained by directly grinding by a crusher such as a ball mill or a roll mill and also by grinding in a wet process with a solvent.

The iron ore is preferably iron oxide type iron ore especially $\alpha$-$Fe_2O_3$ and $Fe_2O_3.nH_2O$ type iron ore such as Hematite and Limonite.

The optimum iron ore is a combination of $\alpha$-$Fe_2O_3$ and $Fe_2O_3.H_2O$ which is naturally produced in Roberiver (Australia), Algarrobo (Chile), Hamersley and Whyalla (Australia). The compositions of these iron ores are shown in the following table. Hematite is $\alpha$-$Fe_2O_3$ type and Limonite is a combination of $\alpha$-$Fe_2O_3$ type and $Fe_2O_3.H_2O$.

| | Iron Ore | | |
|---|---|---|---|
| | Hematite type Algarrobo (Chile) | Hematite type Hamersley (Australia) | Limonite type Roberiver (Australia) |
| Total Fe | 63.1% | 62.4% | 57.4% |
| $Fe_2O_3$ | 87.0 | 89.0 | 82.01 |
| FeO | 2.9 | 0.2 | 0.12 |
| SiO | 4.8 | 4.6 | 5.6 |
| $Al_2O_3$ | 2.1 | 2.9 | 2.7 |
| $TiO_2$ | 0.1 | 0.1 | 0.2 |
| $Mn_2O_3$, MnO | 0.1 | 0.06 | 0.08 |
| CaO | 0.1 | 0.05 | 0.10 |
| $P_2O_5$ | 0.07 | 0.14 | 0.08 |
| S | 0.07 | 0.02 | 0.03 |
| Cu | 0.005 | 0.002 | 0.002 |
| Zn | 0.016 | 0.004 | 0.003 |
| As | 0.005 | 0.019 | 0.006 |

Hematite type Whyalla (Australia) is $\alpha$-$Fe_2O_3$ type which contains 60% of Fe component.

The catalyst is effective not only for the solvent refining carbonization of coal having low rank of coalification such as brown coal but also bituminous coal and is effectively used at a reaction temperature of 350° to 500° C. preferably 380° to 450° C. under a hydrogen partial pressure of 20 to 250 kg/cm$^2$G preferably 75 to 200 kg/cm$^2$G for a reaction time of 5 to 120 minutes.

The object heavy liquefied product can be effectively obtained in the above-mentioned conditions depending upon the kinds of the coals. Petroleum type hydrocarbons can be used as the solvent, though Coal type hydrocarbons especially anthracene oil and creosote oil are preferably used. The solvents preferably have a boiling point of 150° to 450° C. under the atmospheric pressure.

The solvent is recovered after the reaction and is reused. When the hydrogenolysis of a solvent is resulted in the reaction to convert the components into light oil such as naphtha, the balance of the solvent in the process is unbalanced to cause an inoperable as the process. Thus, the catalyst of the present invention is effective to minimize the variation of the solvent.

The pulverized iron ore catalyst of the present invention is effective as the catalyst by itself. Thus, it is preferable to combine it with element sulfur or a sulfur compound such as hydrogen sulfide. A content of sulfur of element sulfur or a sulfur compound is preferably at a rate of 0.1 to 3 times by weight of the iron component in the catalyst. When a content of reactive sulfur compounds in the coal is high, the content of sulfur in the catalyst can be small.

The catalyst of the present invention can be used in the reaction in a form of suspension. The reaction can be a batch or continuous system. In an industrial process, the catalyst, the coal and the solvent are mixed and continuously fed into a tank equipped with a stirrer or a tower type reactor such as a bubbling tower which is preheated under a hydrogen pressure and the reaction mixture is continuously discharged, and if necessary, the solid components such as a catalyst and an insoluble matters are separated and the solvent is recovered by a distillation to obtain the solvent refined coal as a residue. The use of the fine catalyst of the present invention is remarkably effective from the viewpoint of the prevent of a sedimentation and a pile of the catalyst in the reactor.

The solvent refined coal obtained by a pulverized iron ore catalyst of the present invention contains only small insoluble coal and can be used as a source for carbon products and also useful as a source for producing light oil by a combination of the further hydrogenolysis as described above.

The present invention will be further illustrated by certain examples and references which are provided for purposes of illustration only and are not intended to be limiting the present invention.

EXAMPLE 1

A pulverized iron ore having particle diameters of less than 35μ (27.9 m$^2$/g of a specific surface area measured by the BET method adsorbing nitrogen gas) was produced by grinding iron ore (produced in Roberiver of Australia). The pulverized iron ore was added to brown coal (200 mesh pass) produced in Moel of Australia at a ratio of 1.0 wt.% based on an anhydrous ashless coal, and sulfur was further added at an equivalent to iron component in the catalyst. Cresote oil having a boiling point of 180° to 400° C. was admixed with the mixture of the brown coal, the catalyst and the sulfur to produce a slurry. The slurry was treated in an autoclave at 425° C. under an initial hydrogen pressure of 90 kg/cm$^2$G for a reaction time of 60 minutes, to carry out a liquefaction. The product has 12.7 wt.% of ashless quinoline-insoluble matters and 36.0 wt.% of ashless benzene insoluble matters based on the anhydrous ashless coal.

EXAMPLE 2

A pulverized iron ore having an average particle diameters of 45μ (25.1 m$^2$/g. of a specific surface area measured by the BET method adsorbing nitrogen gas) was produced by grinding iron ore (produced in Roberiver of Australia). The pulverized iron ore was added to brown coal (200 mesh pass) produced in Moel of Australia at a ratio of 2.0 wt.% based on an anhydrous ashless coal and sulfur was further added at an equivalent to iron component in the catalyst.

In accordance with the process of Example 1, except using the mixture, a slurry was prepared in the cresote oil and a hydrogenolysis of coal was carried out. The product had 20.2 wt.% of ashless quinoline-insoluble matters and 43.4 wt.% of ashless benzene insoluble matters based on the anhydrous ashless coal.

EXAMPLE 3

Iron ore produced in Whyalla of Australia was crushed and sieved to pass through a 400 mesh sieve and was further ground by a wet grinding process to have particle diameters of less than 10μ and an average particle diameter of 3 to 4μ (19.7 m$^2$/g of a specific surface area measured by the BET method). The pulverized iron ore was added to 10 g. (8.3 g. as anhydrous and ashless form) brown coal (200 mesh pass) produced in Moel of Australia at a ratio of 1.0 wt.% based on an anhydrous ashless coal, and sulfur was further added at an equivalent to iron component in the catalyst. Thirty grams of 1-methylnaphthalene were admixed with the mixture of the brown coal, the catalyst and the sulfur to produce a slurry. In accordance with the process of Example 1, except using the slurry, a hydrogenolysis of coal was carried out. The product had 14.8 wt.% of ashless quinoline-insoluble matters and 31.9 wt.% of ashless benzene insoluble matters based on the anhydrous ashless coal. The conversion was 85.2%.

EXAMPLES 4 TO 10

In accordance with the process of Example 3 except using each pulverized iron ore shown in the following table, each hydrogenolysis of coal was carried out. The results are shown in the following table.

The iron ores of Roberiver, Whyalla, Hamersley and Algarrobo shown in the above-mentioned table were used.

Each iron ore was crushed and sieved to pass through a 400 mesh sieve and was further ground by a wet grinding process to have particle diameters of less than 10μ and an average particle diameter of 3 to 4μ. This is referred to as fine powder.

Each iron ore was crushed and sieved to pass through a 400 mesh sieve to have particle diameters of less than 37μ and an average particle diameter of 15μ. This is referred to as the 400 mesh pass powder.

| | Catalyst | | | |
|---|---|---|---|---|
| | Whyalla Hematite | | Roberiver Limonite | |
| | Exp. 3 fine powder | Exp. 4 400 mesh pass | Exp. 5 fine powder | Exp. 6 400 mesh pass |
| Specific surface area (m$^2$/g) | 19.7 | 13.0 | 48.4 | 29.6 |
| Ratio of catalyst to coal | 1.0 | 1.52 | 1.0 | 1.64 |
| Quinoline insoluble matter (%) | 14.8 | 22.4 | 12.7 | 16.2 |
| Benzene insoluble matter (%) | 31.9 | 37.3 | 27.6 | 33.2 |
| Conversion (%) | 85.2 | 77.6 | 87.3 | 83.8 |

| | Catalyst | | | |
|---|---|---|---|---|
| | Hamersley Hematite | | Algarrobo Hematite | |
| | Exp. 7 fine powder | Exp. 8 400 mesh pass | Exp. 9 fine powder | Exp. 10 400 mesh pass |
| Specific surface area (m$^2$/g) | 26.0 | 14.3 | 15.2 | 14.6 |
| Ratio of catalyst to coal | 1.0 | 1.82 | 1.0 | 1.04 |
| Quinoline insoluble matter (%) | 19.2 | 27.7 | 23.9 | 34.3 |
| Benzene insoluble matter (%) | 34.0 | 40.1 | 37.4 | 46.4 |
| Conversion (%) | 80.8 | 72.3 | 76.1 | 65.7 |

We claim:

1. In a liquefaction of coal to a heavy liquefied product by heating coal with a hydrocarbon solvent under a hydrogen pressure atmosphere in the presence of a catalyst, an improvement characterized in that said catalyst is a pulverized hematite or limonite iron ore, wherein said pulverized iron ore has a particle diameter of substantially all less than 10μ with an average particle size of about 3–4μ, with or without added sulfur or sulfur compound, wherein said pulverized iron ore is used at a ratio of 0.1 to 10 wt.% based on the anhydrous ashless coal, wherein said temperature for liquefaction is at 350° to 500° C., and wherein said hydrogen is at a partial pressure in a range of 20 to 250 kg/cm$^2$G.

2. A liquefaction of coal according to claim 1 wherein said time for liquefaction is in a range of 5 to 120 minutes.

3. A liquefaction of coal according to claim 2 wherein the ratio of hydrogen contacted with coal is at a ratio of 1 to 20 wt.% based on the anhydrous ashless coal.

4. A liquefaction of coal according to claim 3 wherein the coal is bituminous coal or brown coal, the hydrogen partial pressure is 75 to 200 kg/cm$^2$G, the reaction time is 5 to 120 minutes, and the solvent is anthracene oil or creosote oil.

* * * * *